US006786833B2

(12) United States Patent
Ahrend

(10) Patent No.: US 6,786,833 B2
(45) Date of Patent: Sep. 7, 2004

(54) GOLF SWING TRACKING DEVICE

(75) Inventor: Todd W. Ahrend, Tulsa, OK (US)

(73) Assignee: Tracker Golf LLC, Tulsa, OK (US)

( * ) Notice: Subject to any disclaimer, the term of this patent is extended or adjusted under 35 U.S.C. 154(b) by 0 days.

(21) Appl. No.: 10/347,670

(22) Filed: Jan. 20, 2003

(65) Prior Publication Data

US 2004/0142757 A1 Jul. 22, 2004

(51) Int. Cl.[7] ..... A63B 69/36
(52) U.S. Cl. ..... 473/265
(58) Field of Search ..... 473/265, 261, 473/264, 257, 262, 263, 238, 251, 252, 253, 258, 260, 278

(56) References Cited

U.S. PATENT DOCUMENTS

| | | | | |
|---|---|---|---|---|
| 1,383,876 A | | 7/1921 | Sullivan | |
| 1,532,984 A | | 4/1925 | Borthwick | |
| 2,152,381 A | | 3/1939 | Harpster | |
| 2,712,939 A | * | 7/1955 | Harp | 473/265 |
| 2,801,857 A | | 8/1957 | Strunk | |
| 3,107,920 A | | 10/1963 | Strunk | |
| 3,113,780 A | | 12/1963 | Livingstone | |
| 3,194,565 A | | 7/1965 | Schroer | |
| 3,741,550 A | | 6/1973 | Landures | |
| 3,894,739 A | * | 7/1975 | Goldstein | 473/225 |
| 4,180,270 A | * | 12/1979 | Long | 473/225 |
| 4,465,281 A | | 8/1984 | Whitfield | |
| 4,526,373 A | | 7/1985 | Medlock | |
| 4,732,390 A | | 3/1988 | McCollum | |
| 4,913,440 A | | 4/1990 | Ellington | |
| 5,263,719 A | | 11/1993 | Bunn | |
| 5,350,177 A | | 9/1994 | Furbush, Jr. | |
| 5,855,523 A | | 1/1999 | Hatchett | |
| 5,961,393 A | | 10/1999 | Heller et al. | |

* cited by examiner

*Primary Examiner*—Stephen P. Garbe
*Assistant Examiner*—Nini F. Legesse
(74) *Attorney, Agent, or Firm*—Head, Johnson and Kachigian

(57) ABSTRACT

A golfing aid comprising a guide structure in the form of a base member with a plurality of swing deviation indicators pivotally mounted thereon with the indicators positioned on opposite sides of a desired area defining an intended club head swing path, the deviation indicators are each yieldably mounted in a manner to allow a responding rotation upon being struck by a club head deviating from the intended club head swing path.

17 Claims, 3 Drawing Sheets

GOLF SWING TRACKING DEVICE

REFERENCE TO PENDING APPLICATIONS

This application is not related to any pending applications.

REFERENCE TO MICROFICHE APPENDIX

This application is not referenced in any microfiche appendix.

TECHNICAL FIELD OF THE INVENTION

In general, the invention relates generally to the field of golf practice devices and in particular to those devices equipped with swing deviation indicators to visually display deviations from a desired path of golf club head travel.

BACKGROUND OF THE INVENTION

Golf practice devices of the general type are not new. See, for example, U.S. Pat. Nos. 3,018,109, 3,107,920 and 3,113,780. In all instances of these devices, however, a great impact force exerted on knockdown pegs by a golf club swung without restraint has made it extremely difficult to prevent uprooting of the pegs and to insure a reasonably long useful life for the device.

The art enhancing teachings of the instant invention discuss, disclose and claim swing deviation indicators which are reliably rotated on a pivot means to visually indicate an improper swing and are resilient enough to withstand repeated club head impact. The instant invention's swing deviation indicators allow rapid return to an original swing monitoring position by avoiding the deficiencies of prior art teachings in which upright indicator are struck in an attempt to visually indicate a desired golf club swing path. The instant invention improves upon the art by providing the requisite degree of accuracy in terms of golf swing direction while further avoiding the deficiencies of the prior art wherein vertically oriented knockdown pegs have been utilized and found extremely difficult to uproot and reposition.

Other objects and further scope of the applicability of the present invention will become apparent from the detailed description to follow, taken in conjunction with the accompanying drawings wherein like parts are designated by like reference numerals.

BRIEF SUMMARY OF THE INVENTION

A golfing aid comprising a guide structure in the form of a base member with a plurality of swing deviation indicators pivotally mounted thereon with the indicators positioned on opposite sides of a desired area defining an intended club head swing path, the deviation indicators each yieldably mounted in a manner to allow responding rotation upon being struck by a club head deviating from said intended club head swing path.

DETAILED DESCRIPTION OF THE PREFERRED EMBODIMENT

While the making and using of various embodiments of the present invention are discussed in detail below, it should be appreciated that the present invention provides for inventive concepts capable of being embodied in a variety of specific contexts. The specific embodiments discussed herein are merely illustrative of specific manners in which to make and use the invention and are not to be interpreted as limiting the scope of the instant invention.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is clear that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

Figure 1:
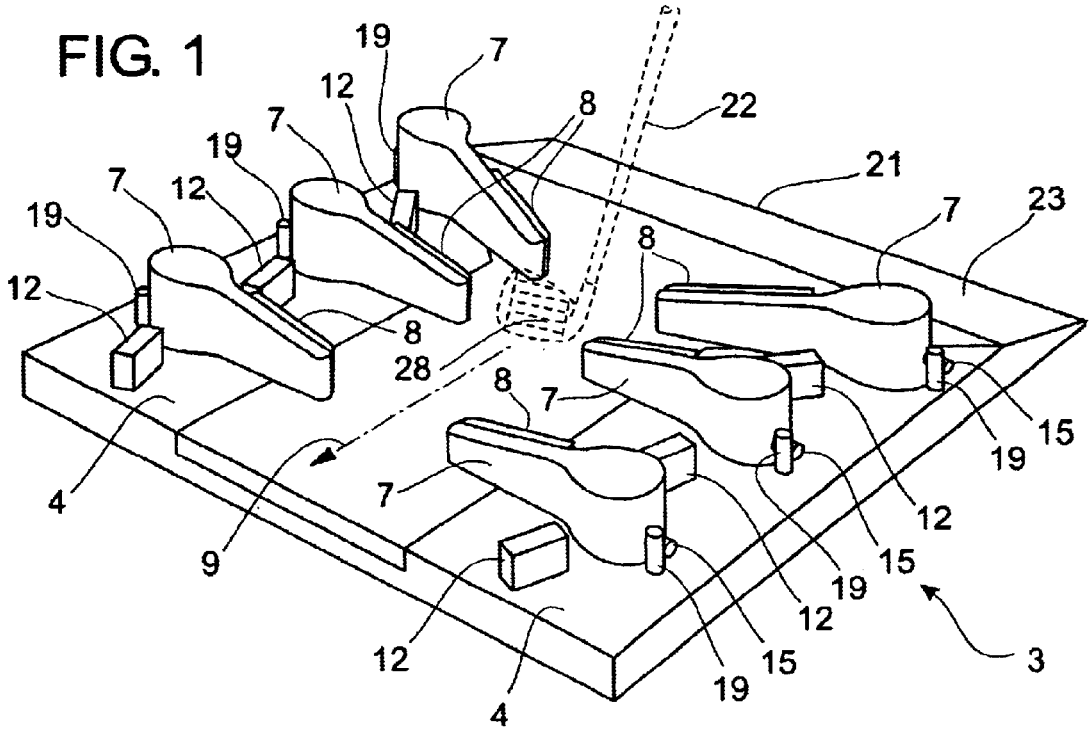
FIG. 1 is an illustration of the instant invention when viewed from a first end and discloses a golf club (in phantom) positioned upon an area defining an intended club head swing path.

FIG. 1 is an illustration of the instant invention when viewed from a first end and discloses a golf club (in phantom) positioned upon desired area defining an intended club head swing path. Turning now to FIG. 1.

In FIG. 1 the golfing aid of the instant invention is generally referred to as element 3 and comprises a base member 4 with a plurality of swing deviation indicators 7 pivotally mounted thereon with the indicators 7 positioned on opposite sides of a desired area defining an intended golf club swing path 9. The means of pivoting the first member upon a rotational axis is widely known and practiced. As used herein, the term "pivot" is intended to refer to and encompass all pivoting means which would allow a rotation of a deviation indicator 7 along an axis which would denote, and easily present visually, an indication of said deviation indicator 7 having been struck by a golf club head 28. Though variations of such pivoting means would contemplate and include bearings and ornate axle assemblies, the present invention may be practiced most efficiently utilizing a simple peg-like structure upon which a hollowed out portion of the underside of a deviation indicator 7 may be positioned. The deviation indicators 7 each are yieldably mounted in a manner to allow responding rotation upon being struck by a club head 28 deviating from the intended club head swing path 9. Also shown in FIG. 1 are limitation blocks 12 which restrict the range of rotation of one or more deviation indicators 7. Each of the indicators 7 further comprises a first positioning peg 15 that works in concert with a second positioning peg 19 affixed to the base member 4 to guidably reposition the deviation indicator 7 after being struck by a club head 28 when deviating from the intended club head swing path 9. The deviation indicator 7 further comprise a resilient club head striking surface 8 typically comprised of, though not limited to, a rubber-based or polyurethane-based substance sufficient to absorb repeated impact of the golf club head 28 when deviating from intended swing path 9.

Continuing with the description of FIG. 1, the invention is also shown at one end, an area of incline 23 which allows the traversing thereupon of a golf ball (not shown in FIG. 1) with the inclined area extending from a floor level 21 to base member surface area 4 upon which a golf ball is positioned in anticipation of being struck by golf club head 28. Further discussion and disclosure with respect to the positioning of said golf ball provided in association with FIGS. 4 and 5. To approximate the conditions of an actual striking/playing surface, the inclined area 23 and/or golf club intended swing path area 9 may include a grass-like surface which covers portion routinely making contact with a golf ball when practicing the invention. Such grass-like surfaces are well known to those skilled in the art and are typically associated with trade names, such as Astroturf indoor/outdoor carpeting, etc.

Figure 2:
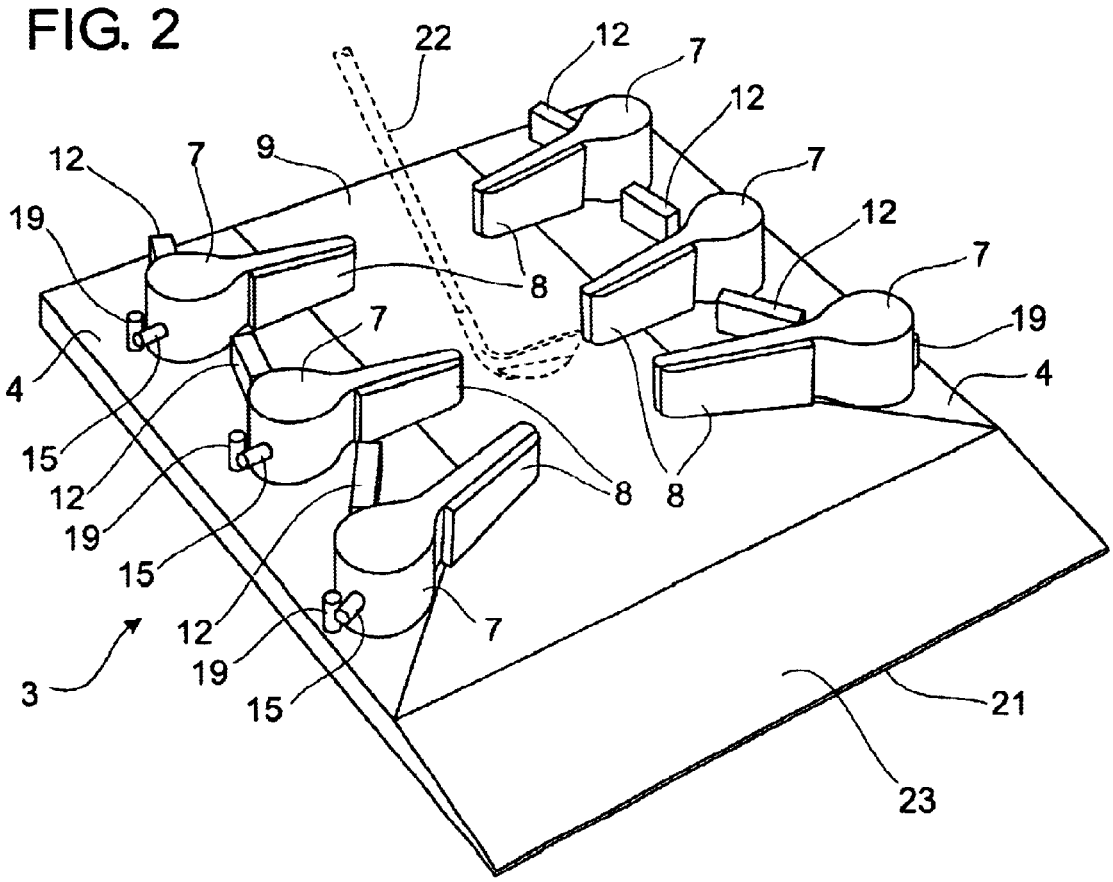
FIG. 2 is an illustration of the instant invention of FIG. 1 when viewed from an end opposite that illustrated in FIG. 1.

FIG. 2 illustrates an opposite view of the invention of FIG. 1 and consistent disclosure is immediately provided wherein the golfing aid of the instant invention is generally referred to as element 3 and comprises a guide structure in the form of a base member 4 with a plurality of swing deviation indicators 7 pivotally mounted thereon with the indicators 7 positioned on opposite sides of a desired area defining an intended golf club swing path 9. The deviation indicators 7 each are yieldably mounted in a manner to allow responding rotation upon being struck by a club head 28 deviating from the intended club head swing path 9. Also shown in FIG. 2 are limitation blocks 12 which restrict the range of rotation of one or more deviation indicators 7. Each of the indicators 7 further comprises a first positioning peg 15 that works in concert with a second positioning peg 19 affixed to the base member 4 to guidably reposition the deviation indicator 7 after being struck by a club head 28 when deviating from the intended club head swing path 9. The deviation indicator 7 further comprise a resilient club head striking surface 8 typically comprised of though not limited to a rubber-based or polyurethane-based substance sufficient to absorb the impact of the golf club head 28 when deviating from the intended swing path 9.

Figure 3:
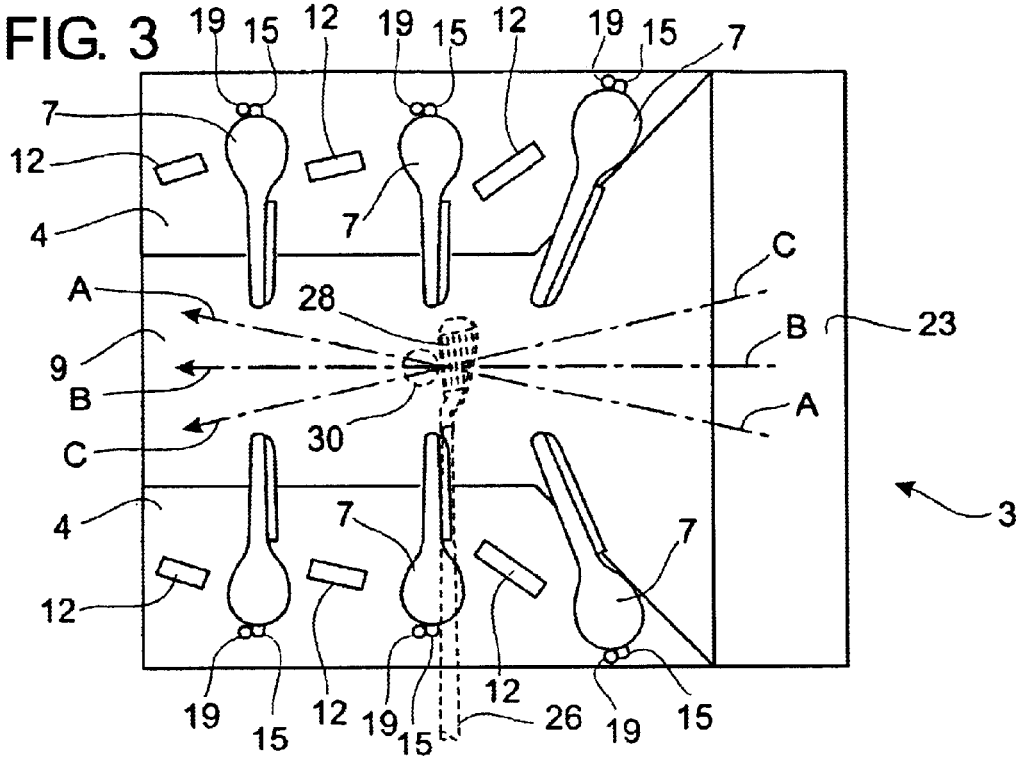
FIG. 3 is an illustration of the instant invention further illustrating placement of a golf ball and golf club in phantom and indicating potential swing paths of the club head when attempting to make contact with the golf ball.

FIG. 3 is an illustration of the instant invention further illustrating a placement of a golf ball and golf club in phantom and indicating potential swing paths of the club head when attempting to make contact with the golf ball. Turning now to FIG. 3.

In FIG. 3 it is observed and disclosed where potential lines of golf swing are indicated as lines A, B and C. Also indicated in FIG. 3 is ball 30, golf club shaft 26 and golf club head 28. A golfer intending to strike golf ball 30 and cause it to move along lines A, B or C would be successful in precipitating such movement if contact is made between the golf head 28 and golf ball 30 without striking any of the deviation indicators 7.

Figure 4:
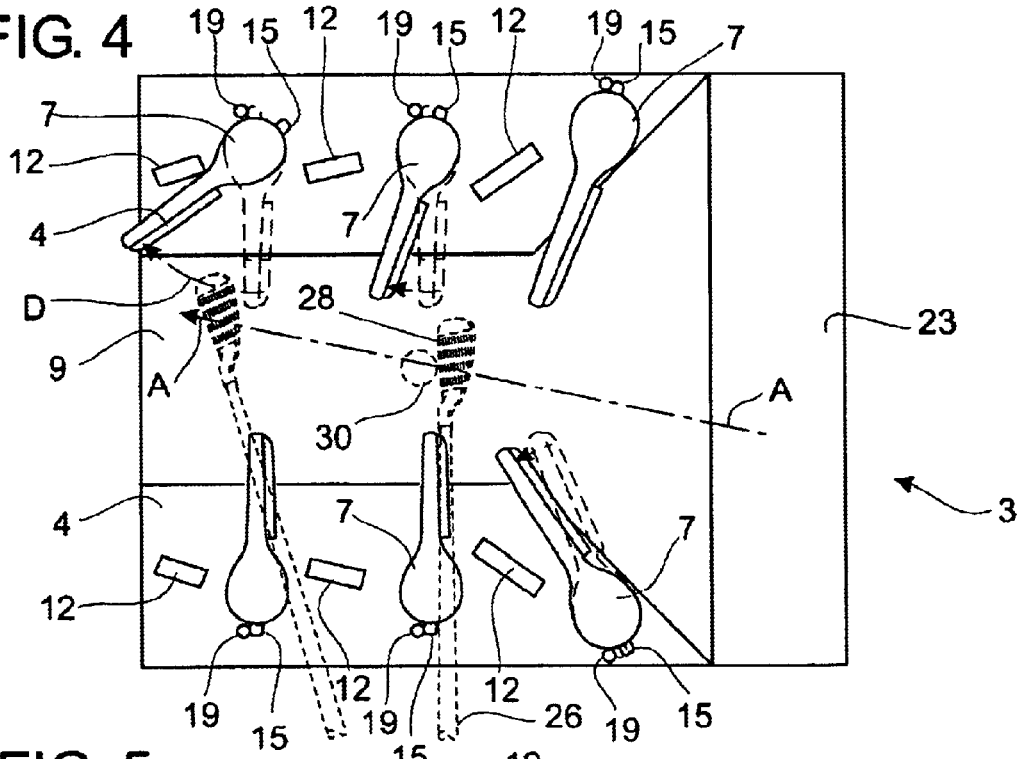
FIG. 4 is an illustration of the instant invention showing the golf club head making contact with a golf ball along a swing path illustrated as line A and causing a deviation indicator to be rotated or otherwise moved along line D.

FIG. 4 illustrates an intended golf practice swing along line A wherein one such deviation indicator has been moved to denote deviation from the intended line of swing. Turning now to FIG. 4.

In FIG. 4 the golf club head 28 is seen striking ball 30 with the intent to cause ball 30 to travel along line A. However, in continuing the golf swing, it is further shown where golf club head 28 deviates sufficiently from the intended swing path to cause contact to be made with left uppermost deviation indicator 7 causing said deviation indicator 7 to move along line D thus providing visual representation of force and scope of swing deviation from intended swing path line A.

Figure 5:
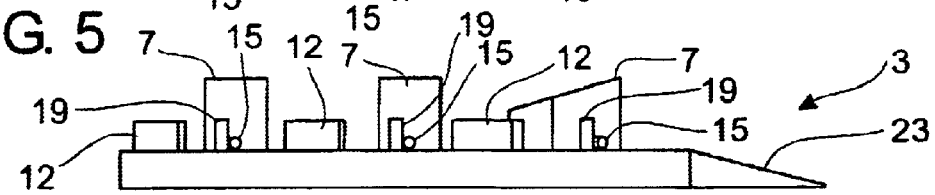
FIG. 5 is a side view illustration of the instant invention illustrating the invention's base member, deviation indicators and pegs.

FIG. 5 illustrates a side view illustration of the invention. Turning now to FIG. 5.

In FIG. 5 it is seen where the base member 4 is shown with pivotally mounted deviation indicators 7. Further illustrated in FIG. 5 are the limitation blocks 12 of the instant invention which limit the responding rotational travel of deviation indicator upon being struck by a golf club head deviating from an intended swing path. Lastly, illustrated in FIG. 5 are the invention's first positioning peg 15 and second positioning peg 19 with said positioning peg 19 mountably affixed to the golf base member 4 and the first positioning peg insertably mounted or otherwise affixed to swing deviation indicator 7.

Figure 6:
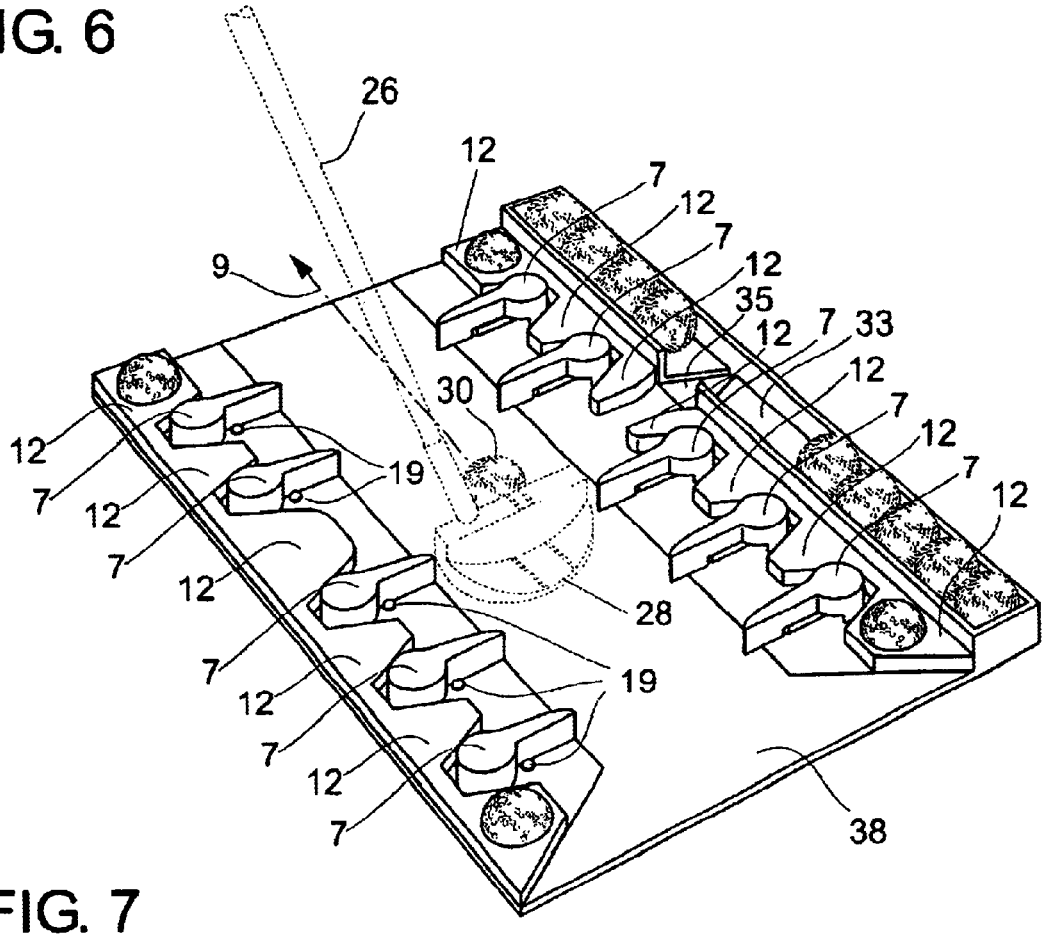
FIGS. 6 and 7 illustrate a readily envisioned alternative embodiment of the instant invention wherein the embodiment is constructed out of a moldable material, such as, but not limited to, plastic or polyurethane based material.

FIG. 6 illustrates a readily envisioned alternative embodiment of the instant invention wherein it is disclosed that the limitation blocks 12 are integrated as part of a uni-body molded structure and preclude excessive rotational travel of deviation indicators 7 as described in association with FIGS. 1 through 5. Further illustrated in FIG. 6 is a golf ball storage area 33 where a golf ball 37 may be stored and rotated or otherwise transported to an inclined ramp 35 whereupon said golf ball 37 would roll down said ramp 35 to the surface area 38 of the invention prior to being positioned as being indicated in 30 for subsequent striking by a golf club head 28 which is attached to a golf club shaft 27. In FIG. 6, element 9 indicates an intended golf club head swing path with the embodiment illustrated in FIG. 6 intended and used most efficiently with utilization of a putter in hopes of improving a golfer's putting stroke. Said golf club head 28 in FIG. 6 is intended to represent a putter golf club head. Also indicated in FIG. 6 are a plurality of second positioning pegs 19 which work in concert with said deviation indicator 7 to allow original positioning prior to practicing the instant invention in an effort to improve ones putting /golf club swing.

Figure 7:
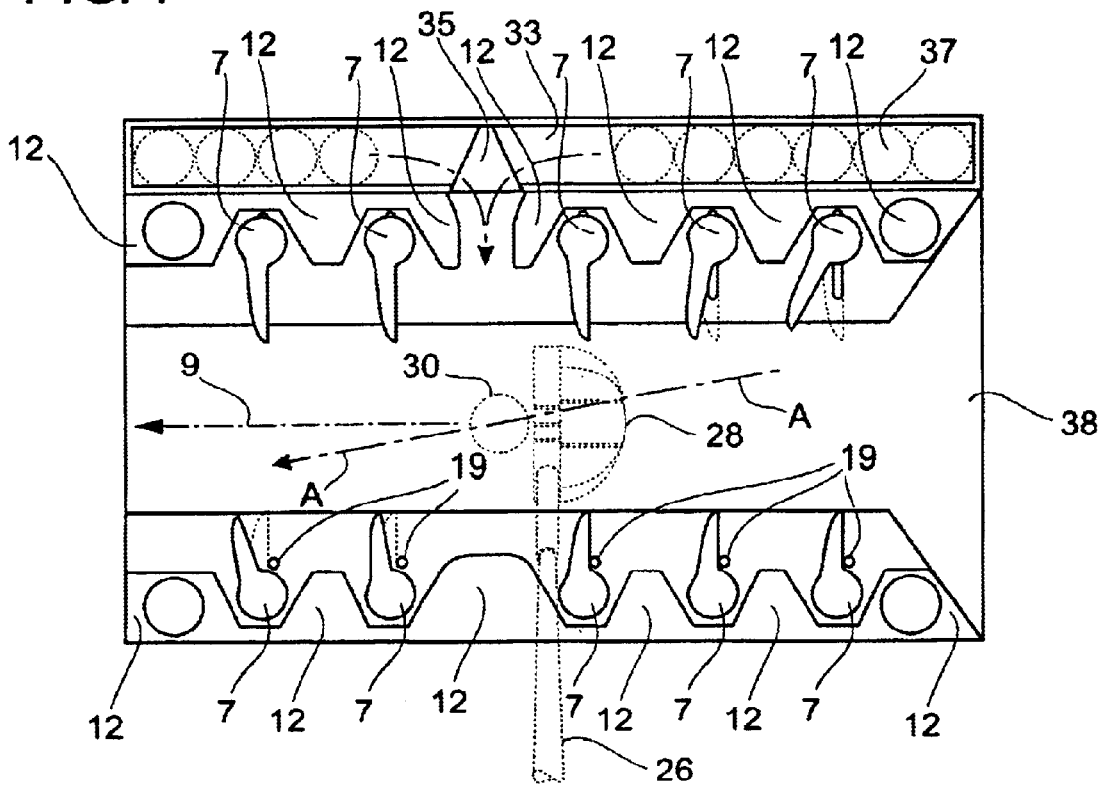

FIG. 7 illustrates a deviated golf club swing from an intended golf club swing path in association with the alternative embodiment of FIG. 6. Turning now to FIG. 7.

In FIG. 7 it is intended that golf club head 28 should follow and drive a golf ball along line 9. However, as indicated in FIG. 7, golf club head 28 is shown moving along the line A and striking or otherwise making contact with deviation indicator 7 in the lowermost left corner of the embodiment of FIG. 7. FIG. 7 further provides clarity with respect to the ramp 35 whereupon a golf ball 37 may be rotated or otherwise moved to allow its descending to surface 38 whereupon it may be positioned as indicated in 30 in anticipation of being struck by golf club head 28.

It will of course be understood that various changes may be made in form, details, arrangement and proportions of the apparatus without departing from the scope of the invention, which generally stated consists of an apparatus capable of carrying out the objects above set forth, in the parts and combination of parts as disclosed and defined in the appended claims.

What is claimed is:

1. A golfing aid comprising a base member with a plurality of swing deviation indicators pivotally mounted thereon with the indicators positioned on opposite sides of a desired area defining an intended club head swing path, the deviation indicators each yieldably mounted in a manner to allow responding rotation in a horizontal plane parallel to the area defining the intended club head swing path whenever said deviation indicators are struck by a club head deviating from said intended club head swing path; and wherein the base member further comprises one or more indicator travel limitation blocks to restrict the horizontal plane rotation of one or more deviation indicators.

2. The invention of claim 1 wherein at least one of said deviation indicators further comprises a first positioning peg and wherein said base member further comprises at least one second positioning peg to guidably reposition said indicator subsequent to being struck by a club head deviating from said intended club head swing path.

3. The invention of claim 1 wherein said swing deviation indicators further comprise a resilient club head striking surface.

4. The invention of claim 1 wherein said base member further comprises at one end an area of incline to allow the traversing thereupon of a golf ball, said area of incline extending from floor level to a base member surface area upon which a golf ball is positioned in anticipation of being struck by a golf club head.

5. The invention of claim 1 wherein the base member further comprises a grass-like surface covering portions routinely making contact with a golf ball when practicing the invention.

6. The invention of claim 1 wherein the base member further comprises a golf ball storage area.

7. The invention of claim 1 wherein the base member further comprises a golf ball return ramp extending along an incline extending from said golf ball storage area to a base member surface area upon which a golf ball is positioned in anticipation of being struck by a golf club head.

8. The invention of claim 1 wherein said base member is comprised of a moldable resilient material.

9. The invention of claim 1 wherein said swing deviation indicators is comprised of a moldable resilient material.

10. A golfing aid comprising a base member with a plurality of swing deviation indicators pivotally mounted thereon with the indicators positioned on opposite sides of a desired area defining an intended club head swing path, the deviation indicators each yieldably mounted in a manner to allow responding rotation along a horizontal plane parallel to the area defining an intended club head swing path whenever said deviation indicators are struck by a club head deviating from said intended club head swing path:

a plurality of travel limitation blocks attached to said base member to restrict the range of horizontal plane rotation of one or more deviation indicators;

at least one first positioning peg attached to said swing deviation indicators; and at least one second positioning peg attached to said base member.

11. The invention of claim 10 wherein said base member further comprises at one end an area of incline to allow the traversing thereupon of a golf ball, said area of incline extending from floor level to a base member surface area upon which a golf ball is positioned in anticipation of being struck by a golf club head.

12. The invention of claim 10 wherein said swing deviation indicators further comprise a club head striking surface.

13. The invention of claim 10 wherein said base member is comprised of a moldable resilient material.

14. The invention of claim 10 wherein said swing deviation indicators is comprised of a moldable resilient material.

15. The invention of claim 10 wherein the base member further comprises a grass-like surface covering portions routinely making contact with a golf ball when practicing the invention.

16. The invention of claim 10 wherein the base member further comprises a golf ball storage area.

17. The invention of claim 10 wherein the base member further comprises a golf ball return ramp extending along an incline extending from said golf ball storage area to a base member surface area upon which a golf ball is positioned in anticipation of being struck by a golf club head.

* * * * *